US011976478B2

(12) United States Patent
Wang

(10) Patent No.: US 11,976,478 B2
(45) Date of Patent: May 7, 2024

(54) BUILDING FORMWORK APPARATUS HAVING LOCKING MEMBER

(71) Applicant: Chien-Ho Wang, Taichung (TW)

(72) Inventor: Chien-Ho Wang, Taichung (TW)

( * ) Notice: Subject to any disclaimer, the term of this patent is extended or adjusted under 35 U.S.C. 154(b) by 14 days.

(21) Appl. No.: 17/826,453

(22) Filed: May 27, 2022

(65) Prior Publication Data

US 2023/0092718 A1 Mar. 23, 2023

(30) Foreign Application Priority Data

Sep. 22, 2021 (TW) ..... 110135146

(51) Int. Cl.
*E04G 17/065* (2006.01)
*E04G 9/08* (2006.01)
*E04G 11/06* (2006.01)

(52) U.S. Cl.
CPC ..... *E04G 17/065* (2013.01); *E04G 9/08* (2013.01); *E04G 11/06* (2013.01)

(58) Field of Classification Search
CPC ..... E04G 17/065; E04G 17/02; E04G 17/04; E04G 17/042; E04G 2017/008; E04G 9/08; E04G 2009/028; E04G 11/06; E05C 3/36; E05C 5/04; Y10S 70/39
USPC ..... 249/44, 47, 192, 196; 292/22, 301, 337
See application file for complete search history.

(56) References Cited

U.S. PATENT DOCUMENTS 1,364,736 A * 1/1921 Domanski ..... E05C 5/04 70/393
1,382,758 A * 6/1921 Brown ..... E05C 5/04 292/251
1,410,829 A * 3/1922 Morgenthau ..... E05C 5/04 70/149
1,424,136 A * 7/1922 Morgenthau ..... E05C 5/04 70/149
2,297,899 A * 10/1942 Krueger ..... E04G 17/045 182/129

(Continued)

FOREIGN PATENT DOCUMENTS

CH 113786 A * 2/1926 ..... F16B 23/0038
CN 201902114 U * 7/2011 ..... E05B 65/0075

(Continued)

OTHER PUBLICATIONS

Translation of EP 1,882,794 A1. (Year: 2008).*

(Continued)

*Primary Examiner* — Brian E Glessner
*Assistant Examiner* — Daniel J Kenny
(74) *Attorney, Agent, or Firm* — Burris Law, PLLC

(57) ABSTRACT

A building formwork apparatus includes a building formwork having a frame with a positioning hole and a locking hole, and a locking member including a first tapered section, a second tapered section connected to the first tapered section, and a threaded portion connected to the second tapered section. The positioning hole is configured to receive insertion of the locking member therethrough such that the first tapered section is retained therein and the second tapered section is exposed therefrom for connection with another building formwork apparatus. The locking hole is configured to receive a threaded portion and a second tapered section of a locking member of the another building formwork apparatus.

13 Claims, 8 Drawing Sheets

(56) References Cited

U.S. PATENT DOCUMENTS

| | | | | | |
|---|---|---|---|---|---|
| 2,526,381 | A * | 10/1950 | Mathis | E04G 11/10 | 249/196 |
| 3,872,904 | A * | 3/1975 | Barlow | B25B 15/005 | 81/460 |
| 5,104,070 | A * | 4/1992 | Johnson | E05C 5/04 | 244/172.4 |
| 5,174,909 | A * | 12/1992 | Ward | E04G 17/04 | 249/47 |
| 5,265,836 | A * | 11/1993 | Dale | E04G 17/047 | 249/191 |
| 5,288,051 | A * | 2/1994 | Ward | E04G 17/04 | 292/DIG. 58 |
| 5,686,010 | A * | 11/1997 | Lee | E04G 11/06 | 249/161 |
| 6,428,061 | B1 * | 8/2002 | Daoud | E05C 5/04 | 411/910 |
| 6,691,976 | B2 * | 2/2004 | Myers | E04G 17/047 | 249/191 |
| 8,864,100 | B2 * | 10/2014 | Ward | E04G 17/04 | 292/164 |
| 2020/0139523 | A1 * | 5/2020 | Campbell, II | B25B 15/008 | |

FOREIGN PATENT DOCUMENTS

| | | | | |
|---|---|---|---|---|
| CN | 112593701 | A | 4/2021 | |
| DE | 10119799 | A1 * | 10/2002 | F16B 15/00 |
| DE | 202010012699 | U1 * | 1/2011 | E05B 17/0025 |
| DE | 102009044357 | A1 * | 5/2011 | B25B 15/008 |
| DE | 102020004179 | A1 * | 1/2022 | B25B 15/005 |
| EP | 0123264 | A2 | 10/1984 | |
| EP | 1818479 | A1 * | 8/2007 | E04G 17/042 |
| EP | 1882794 | A1 | 1/2008 | |
| FR | 2470220 | A1 * | 5/1981 | E04G 17/042 |
| FR | 2851308 | A1 * | 8/2004 | F16B 1/0071 |
| FR | 2904022 | A1 * | 1/2008 | E04G 17/042 |
| FR | 3079540 | A1 * | 10/2019 | E04G 17/042 |
| GB | 1534414 | A * | 12/1978 | B25B 15/004 |
| JP | S4729677 | Y1 | 9/1972 | |
| JP | S61127911 | A | 6/1986 | |
| JP | H06136938 | A | 5/1994 | |
| JP | 11030215 | A * | 2/1999 | F16B 23/0038 |
| JP | H11223164 | A | 8/1999 | |
| JP | 2005042877 | A | 2/2005 | |
| JP | 3182061 | U | 3/2013 | |
| KR | 20120017693 | A * | 2/2012 | F16B 23/0038 |
| KR | 20170081836 | A | 7/2017 | |
| TW | 519686 | U * | 4/2016 | F16B 23/0015 |
| TW | I716319 | B | 1/2021 | |

OTHER PUBLICATIONS

Search Report appended to an Office Action, which was issued to Taiwanese counterpart application No. 110135146 by the TIPO dated Jun. 27, 2022, with an English translation thereof.

Office Action issued to Japanese counterpart application No. 2022-094385 by the JPO dated Jun. 19, 2023, with an English translation thereof.

Search Report issued to European counterpart application No. 22177073.8 by the EPO dated Oct. 27, 2022.

Examination Report issued to Korean counterpart application No. 10-2022-0080644 by the KIPO on Jan. 30, 2024.

* cited by examiner

BUILDING FORMWORK APPARATUS HAVING LOCKING MEMBER

CROSS-REFERENCE TO RELATED APPLICATION

This application claims priority from Taiwanese Patent Application No. 110135146, filed on Sep. 22, 2021.

FIELD

The disclosure relates to a building formwork apparatus having a locking member.

BACKGROUND

An existing building formwork apparatus, as disclosed in Taiwanese Patent No. 1716319, includes at least four formworks and at least one connecting hornbeam block. Each formwork has a mold surface at one side thereof, a mounting surface at the other side thereof, and two connecting posts disposed on upper and lower ends of the mounting surface. Each connecting post has a plurality of through holes. The connecting hornbeam block has a plurality of connecting holes.

After the formworks are brought to align with and abut against each other, the connecting hornbeam block is then disposed on the connecting posts of the formworks, after which a plurality of fasteners are extended through the through holes and the connecting holes to fix the formworks and the connecting hornbeam block, thereby cooperatively forming the existing building formwork apparatus. However, the positioning of the formworks relies only on the connecting hornbeam block, so that, after assembly, the mold surfaces of the formworks are prone to misalign and become uneven. There is still room for improvement of the existing building formwork apparatus.

SUMMARY

Therefore, an object of the present disclosure is to provide a building formwork apparatus that can alleviate at least one of the drawbacks of the prior art.

Accordingly, a building formwork apparatus of this disclosure comprises a building formwork and a locking member. The building formwork includes a wall plate and a frame disposed on the wall plate. The wall plate has a mounting surface and a mold surface opposite to the mounting surface. The frame is disposed on the mounting surface, and has at least one positioning hole and at least one locking hole. The locking hole has an internally threaded section. The locking member extends along and is rotatable about an axis, and includes a driven portion, a shoulder formed on one end of the driven portion, a positioning portion, and a threaded portion. The positioning portion includes a first tapered section connected to the shoulder, and a second tapered section connected to the first tapered section at a side opposite to the shoulder. The positioning portion gradually tapers from the first to the second tapered section in a direction away from the shoulder. Each of the first and second tapered sections has a cross section smaller than that of the shoulder. The threaded portion is connected to the second tapered section at a side opposite to the first tapered section, and has an external thread corresponding to the internally threaded section.

The positioning hole is configured to receive insertion of the locking member therethrough such that the first tapered section of the locking member is retained in the positioning hole to restrict the locking member to rotate about the axis and such that the second tapered section of the locking member is exposed from the positioning hole for connection with another building formwork apparatus. The locking hole is adjacent to the positioning hole and is configured to receive a threaded portion and a second tapered section of a locking member of the another building formwork apparatus. The internally threaded section of the locking hole is configured to engage with the threaded portion of the another building formwork apparatus.

BRIEF DESCRIPTION OF THE DRAWINGS

Other features and advantages of the disclosure will become apparent in the following detailed description of the embodiment with reference to the accompanying drawings, in which.

DETAILED DESCRIPTION

Figure 1:
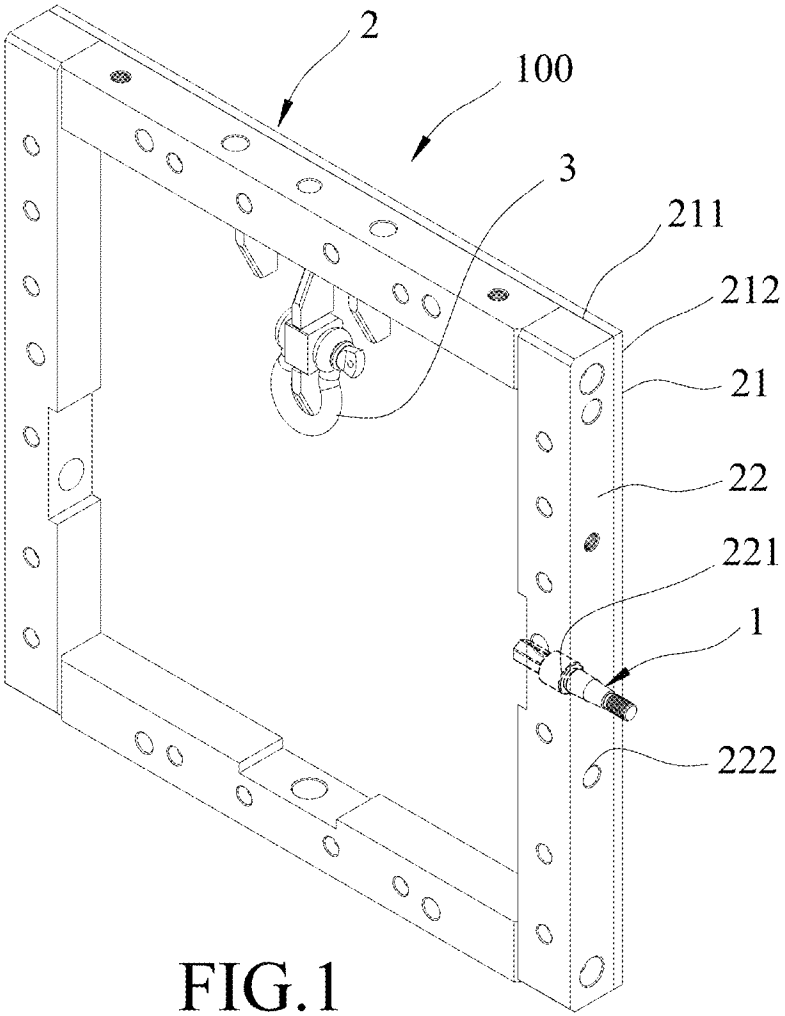
FIG. 1 is a perspective view of a building formwork apparatus according to an embodiment of the present disclosure.
Figure 2:
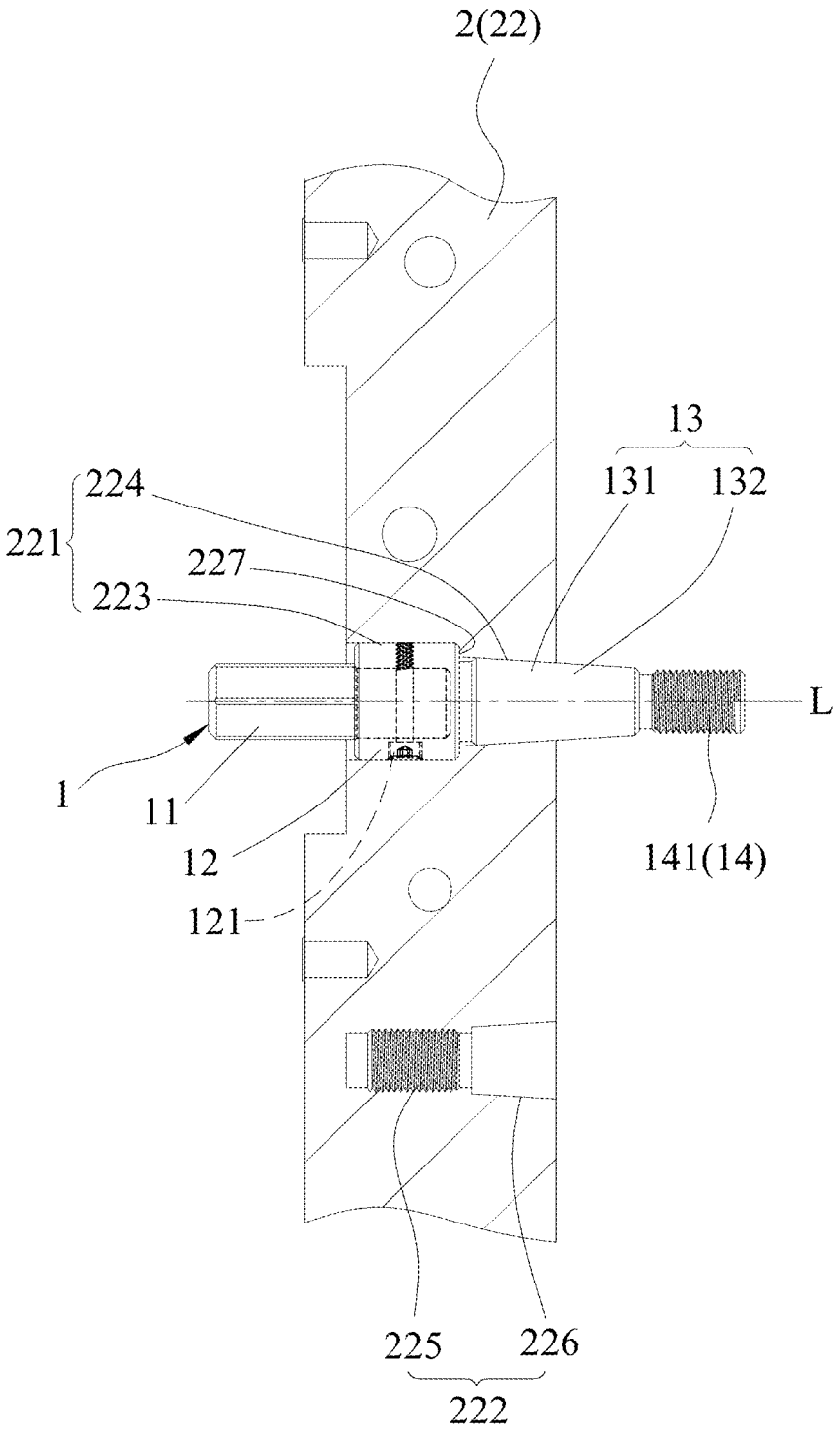
FIG. 2 is an enlarged fragmentary partial sectional view of the embodiment.

Referring to FIGS. 1 and 2, a building formwork apparatus 100 according to an embodiment of the present disclosure is shown to comprise a locking member 1, a building formwork 2, and a hoist ring assembly 3. It should be noted herein that the number of the locking member 1 can be adjusted according to the requirement.

Figure 3:
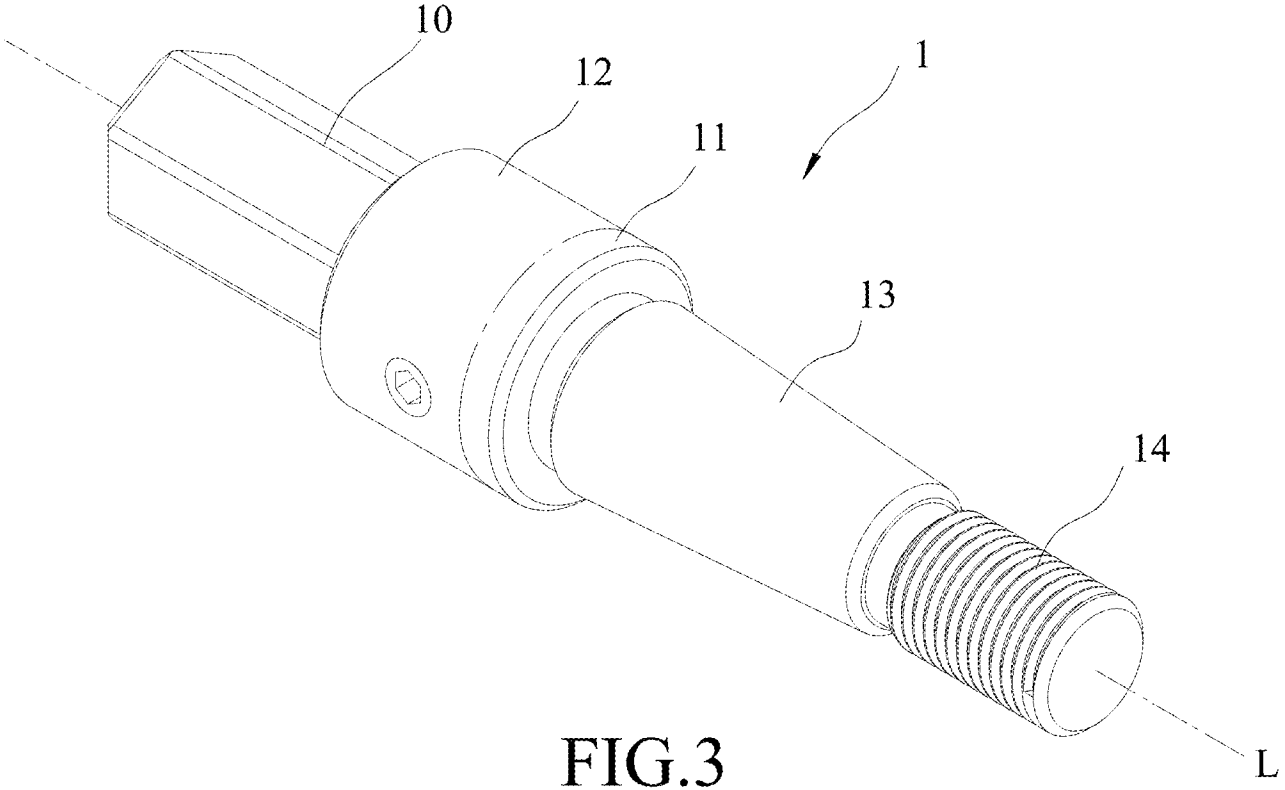
FIG. 3 is a perspective view of a locking member of the embodiment.
Figure 4:
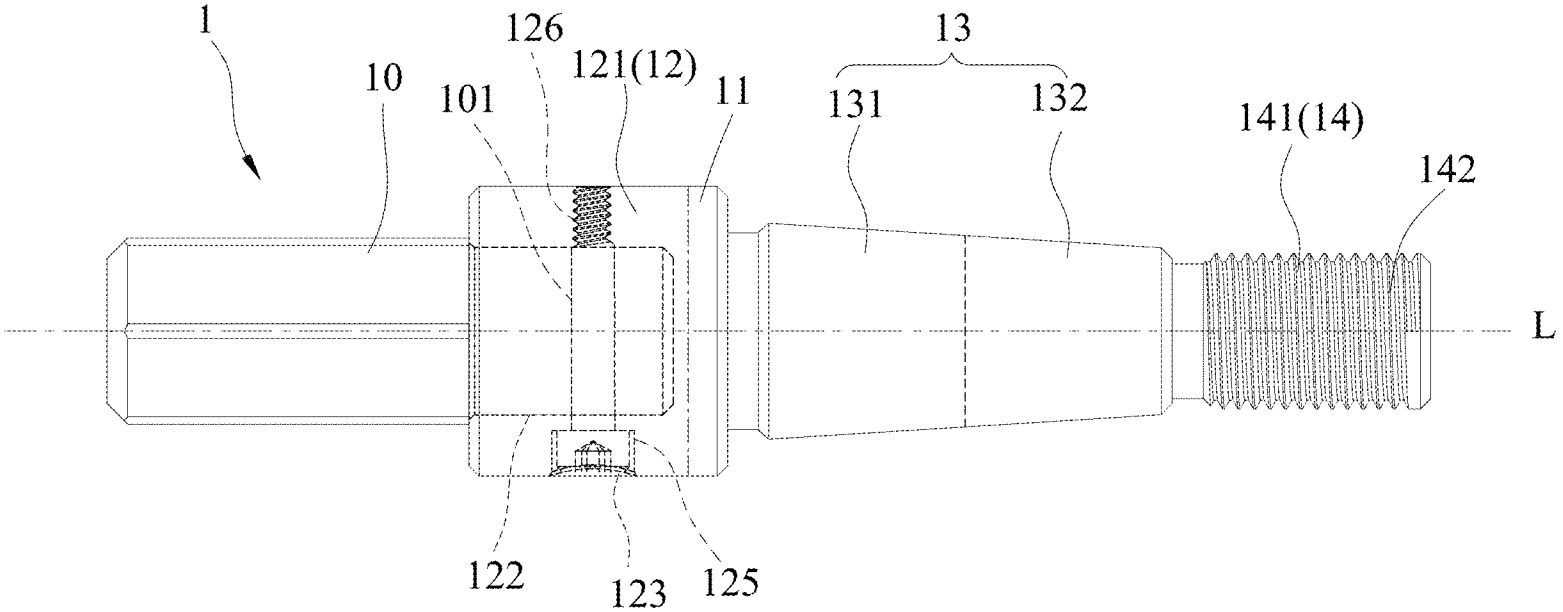
FIG. 4 is a front view of the locking member of FIG. 3.
Figure 5:
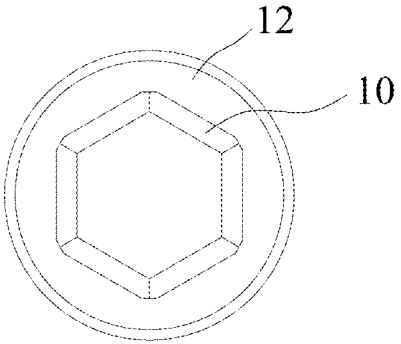
FIG. 5 is a left side view of the locking member of FIG. 3.

Referring to FIGS. 3 to 5, in combination with FIG. 2, the locking member 1 extends along and is rotatable about an axis (L), and includes a connecting rod portion 10, a driven portion 12, a shoulder 11, a positioning portion 13, and a threaded portion 14. The connecting rod portion 10 has a through hole 101 extending transversely through one end thereof. The driven portion 12 includes a surrounding wall 121, a groove 122 defined by the surrounding wall 121, a through hole 125 extending transversely through the surrounding wall 121 and communicating with the groove 122, and a threaded hole 126 diametrically opposed to the through hole 125. The shoulder 11 is formed on one end of the driven portion 12, and is cylindrical, but is not limited thereto.

The connecting rod portion 10 has a shape corresponding to the groove 122, and is hexagonal, as shown in FIG. 5. In this embodiment, the connecting rod portion 10 has the one end inserted into the groove 122 along the axis (L), and through a fixing bolt 123 that extends through the through holes 125 and 101 and threadedly engages the threaded hole 126, the one end of the connecting rod portion 10 is fixed inside the groove 122, thereby preventing separation of the connecting rod portion 10 from the driven portion 12. When the connecting rod portion 10 is rotated, the driven portion 12 is driven by the connecting rod portion 10 to rotate therewith.

In a modification of the locking member 1 of the embodiment, the connecting rod portion 10 thereof may be replaced by a hand tool (such as a drive rod, not shown) to drive the driven portion 12 to rotate therewith. Since the modification of the locking member 1 does not need the connecting rod portion 10, a protruding portion thereof may be reduced.

The positioning portion 13 has a conical shape, and includes a first tapered section 131 connected to the shoulder 11, and a second tapered section 132 connected to the first tapered section 131 at a side opposite to the shoulder 11. The positioning portion 13 gradually tapers from the first tapered section 131 to the second tapered section 132 in a direction away from the shoulder 11 along the axis (L). Each of the first and second tapered sections 131, 132 has a cross section smaller than that of the shoulder 11. In this embodiment, the first and second tapered sections 131, 132 are integrally formed as a single piece, and each of the first and second tapered sections 131, 132 has a taper ratio of 1:8. The shoulder 11 and the positioning portion 13 are integrally formed as a single piece.

The threaded portion 14 is connected to the second tapered section 132 at a side opposite to the first tapered section 131, and has an outer peripheral surface 142 formed with an external thread 141.

Figure 6:
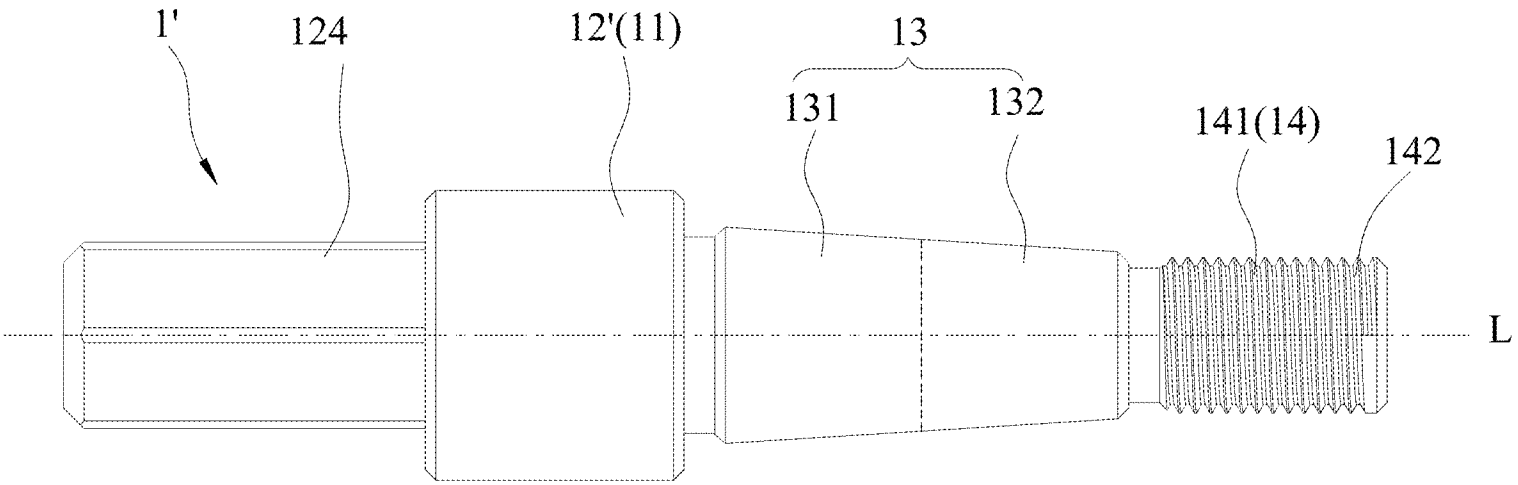
FIG. 6 is a front view of an alternative form of the locking member.

An alternative form of the locking member 1' is shown in FIG. 6. As shown in FIG. 6, the locking member 1' does not include the connecting rod portion 10 (see FIGS. 3 and 4), and the driven portion 12' thereof has a protruding post 124 that is polygonal and that protrudes in a direction opposite to the shoulder 11. The shoulder 11 and the driven portion 12' are integrally formed as a single piece, so that the fixing bolt 123 (see FIG. 4) can be omitted. A hand tool (such as a wrench, not shown) can be inserted into or can clamp the protruding post 124 for rotation therewith.

Referring again to FIGS. 1 and 2, the building formwork 2 includes a wall plate 21 and a frame 22. The wall plate 21 has a mounting surface 211 and a mold surface 212 opposite to the mounting surface 211. The frame 22 is disposed on the mounting surface 211, and has a plurality of positioning holes 221 and a plurality of locking holes 222. Each positioning hole 221 has a large-diameter section 223 corresponding to the driven portion 12, a first tapered hole section 224 corresponding to the first tapered section 131, and a shoulder 227 between the large-diameter section 223 and the first tapered hole section 224. Each locking hole 222 has an internally threaded section 225 corresponding to the external thread 141, and a second tapered hole section 226 corresponding to the second tapered section 132. Each locking hole 222 is adjacent to a respective one of the positioning holes 221.

The hoist ring assembly 3 is provided on the mounting surface 211 of the wall plate 21 to facilitate lifting and moving of the building formwork 2.

Figure 7:
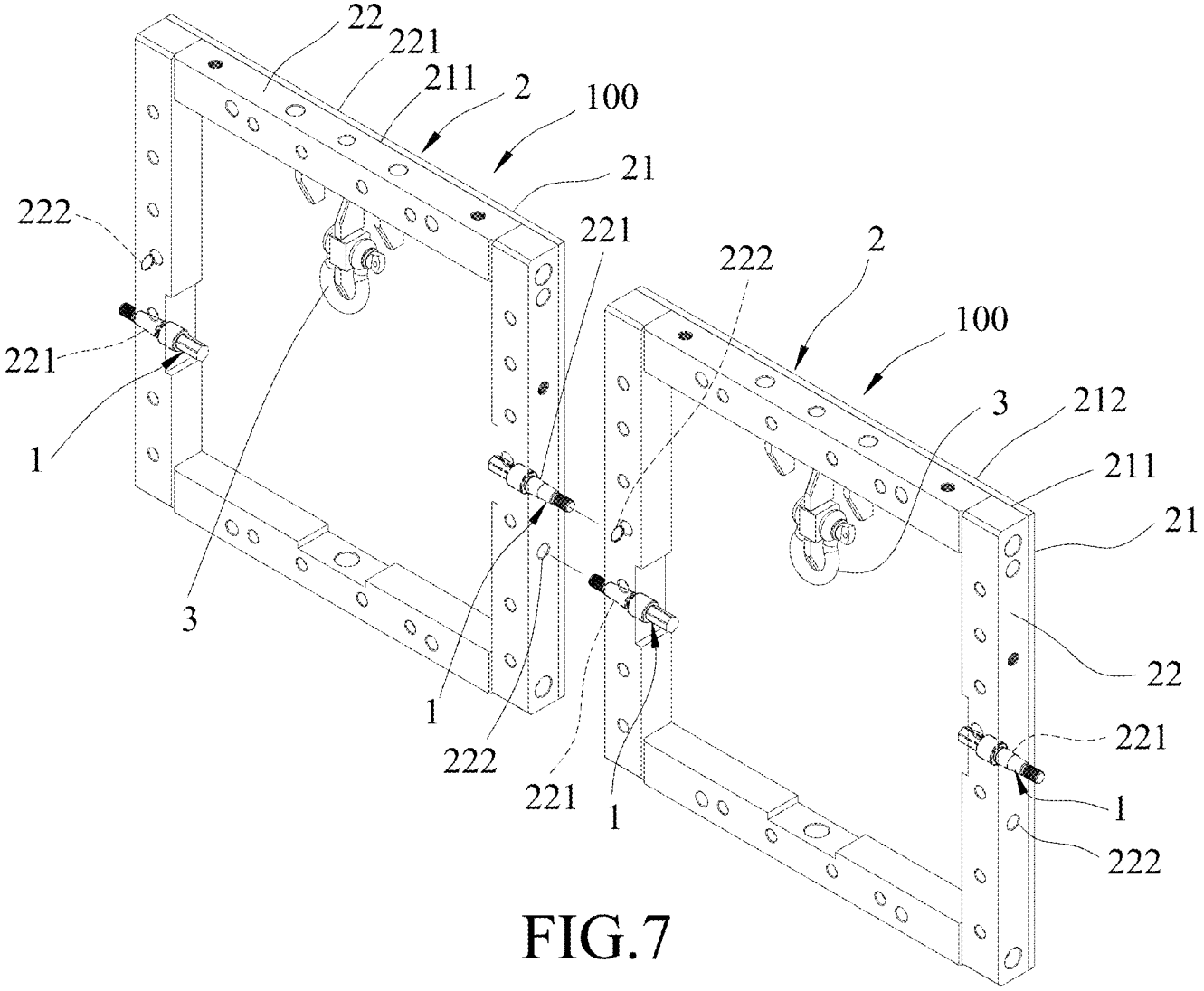
FIG. 7 illustrates how two building formwork apparatuses of the embodiment can be connected to each other.
Figure 8:
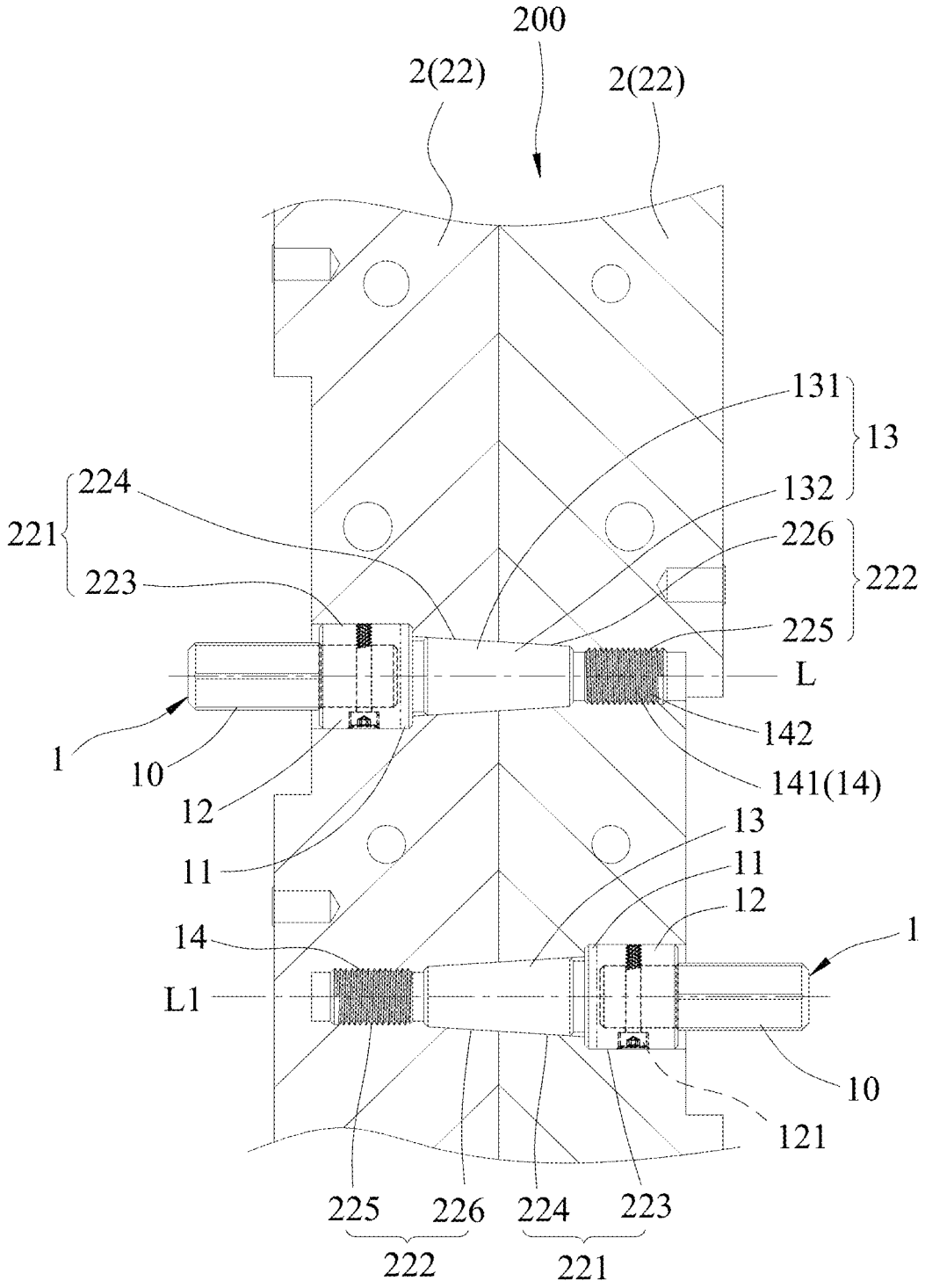
FIG. 8 is an enlarged fragmentary partly sectional view, illustrating how the two building formwork apparatuses of the embodiment are connected to each other.

Referring to FIGS. 7 and 8, the building formwork apparatus 100 of this embodiment may further comprise another locking member 1, so that a plurality of the building formwork apparatuses 100 (only two are shown) may be assembled to form a formwork wall 200. Since interconnection between each two adjacent building formwork apparatuses 100 are similar, only two adjacent building formwork apparatuses 100 will be described hereinafter.

As shown in FIGS. 7 and 8, initially, the two building formwork apparatuses 100 are placed side by side horizontally, after which the locking member 1 of a left building formwork apparatus 100 is inserted into the positioning hole 221 of the building formwork 2 thereof with the driven portion 12, the shoulder 11 and the first tapered section 131 thereof positioned therein, while the second tapered section 132 and the threaded portion 14 thereof extending out of the positioning hole 221 and inserted into an aligned locking hole 222 in the building formwork 2 of a right building formwork apparatus 100. Similarly, the locking member 1 of the right building formwork apparatus 100 is inserted into the positioning hole 221 of the building formwork 2 thereof with the driven portion 12, the shoulder 11 and the first tapered section 131 thereof positioned therein, while the second tapered section 132 of the positioning portion 13 and the threaded portion 14 thereof extending out of the positioning hole 221 and inserted into an aligned locking hole 222 in the building formwork 2 of the left building formwork apparatus 100. Afterwards, the connecting rod portion 10 of the locking member 1 of each building formwork apparatus 100 is rotated to engage the threaded portion 14 with the internally threaded section 225 of the aligned locking hole 222 until the shoulder 11 abuts against the shoulder 227. At this time, the two building formwork apparatuses 100 are moved toward each other and abut against each other. Hence, assembly of the two building formwork apparatuses 100 is completed. By assembling the plurality of the building formwork apparatuses 100 horizontally, the formwork wall 200 extending in the horizontal direction can be formed.

In a variation of this embodiment (not shown), the two building formwork apparatuses 100 may be stacked one above the other, after which the locking member 1 of an upper building formwork apparatus 100 is inserted through the positioning hole 221 of the building formwork 2 thereof into an aligned locking hole 222 in the building formwork 2 of a lower building formwork apparatus 100. Similarly, the locking member 1 of the lower building formwork apparatus 100 is inserted through the positioning hole 221 of the building formwork 2 thereof into an aligned locking hole 222 in the building formwork 2 of the upper building formwork apparatus 100. Afterwards, the connecting rod portion 10 of the locking member 1 of each building formwork apparatus 100 is rotated to engage the threaded portion 14 with the internally threaded section 225 of the aligned locking hole 222, thereby moving the two building formwork apparatuses 100 toward each other and to abut against each other. Hence, assembly of the two stacked building formwork apparatuses 100 is completed. By assembling the plurality of the building formwork apparatuses 100 vertically, the formwork wall 200 extending in the vertical direction can be formed.

It should be noted that the locking member 1 is rotated using a hand tool, such as a wrench (not shown). Further, with the driven portion 12, the shoulder 11 and the first tapered section 131 of the locking member 1 inserted into the positioning hole 221 of the frame 22 of the building formwork 2, deflection of the axis (L) can be limited.

After the assembly of the formwork wall 200 is completed, as shown in FIG. 8, with the first tapered section 131 of each locking member 1 inserted into the positioning hole 221 of the frame 22 of the building formwork 2 of one of the building formwork apparatuses 100, and with the second tapered section 132 thereof inserted into the aligned locking hole 222 of the frame 22 of the building formwork 2 of the other building formwork apparatus 100, in coordination with the deflection of the axis (L) being limited, the frames 22 of the building formworks 2 of the building formwork apparatuses 100 disposed on the mounting surfaces 211 of the wall plates 21 thereof can be flush with each other, and the mold surfaces of the wall plates 21 of the building formworks 2 can also be flush with each other to facilitate subsequent process.

In summary, through the insertion of the positioning portion 13 of the locking member 1 of the building formwork apparatus 100 of this disclosure into the positioning hole 221 of the frame 22 of the building formwork 2 thereof and through the threaded portion 14 thereof that is configured to engage the aligned locking hole 222 in the frame 22 of the building formwork 2 of an adjacent building formwork apparatus 100, the deflection of the axis (L) can be restricted to maintain stability of rotation during assembly; and after the assembly of the plurality of the building formwork apparatuses 100 that are arranged either horizontally or vertically to form the formwork wall 200, the mold surfaces 212 of the wall plates 21 of the building formworks 2 of the building formwork apparatuses 100 can be flush with each other. Therefore, the object of this disclosure can indeed be achieved.

While the disclosure has been described in connection with what is considered the exemplary embodiment, it is understood that this disclosure is not limited to the disclosed embodiment but is intended to cover various arrangements included within the spirit and scope of the broadest interpretation so as to encompass all such modifications and equivalent arrangements.

What is claimed is:

1. A building formwork apparatus comprising:

a building formwork including a wall plate and a frame disposed on said wall plate, said wall plate having a mounting surface and a mold surface opposite to said mounting surface, said frame being disposed on said mounting surface, and having at least one positioning hole and at least one locking hole, said locking hole having an internally threaded section; and a locking member extending along and rotatable about an axis, and including a driven portion, a shoulder formed on one end of said driven portion, a positioning portion including a first tapered section connected to said shoulder, and a second tapered section connected to said first tapered section at a side opposite to said shoulder, said positioning portion gradually tapering from said first tapered section to said second tapered section in a direction away from said shoulder, each of said first tapered section and said second tapered section having a cross section smaller than that of said shoulder, and a threaded portion connected to said second tapered section at a side opposite to said first tapered section, said threaded portion having an external thread corresponding to said internally threaded section;

said positioning hole having a large-diameter section corresponding to said driven portion, and a first tapered hole section corresponding to said first tapered section of said positioning portion;

said positioning hole being configured to receive insertion of said locking member therethrough such that said first tapered section of said locking member is retained in said positioning hole to restrict said locking member to rotate about the axis and such that said second tapered section of said locking member is exposed from said positioning hole for connection with another building formwork apparatus;

said locking hole further having a second tapered hole section corresponding to said second tapered section of said positioning portion; and said locking hole being adjacent to said positioning hole and being configured to receive a threaded portion and a second tapered section of a locking member of the another building formwork apparatus, said internally threaded section of said locking hole being configured to engage with the threaded portion of the another building formwork apparatus.

2. The building formwork apparatus as claimed in claim 1, wherein said driven portion of said locking member includes a surrounding wall, and a groove defined by said surrounding wall.

3. The building formwork apparatus as claimed in claim 2, wherein said locking member further includes a connecting rod portion received in said groove and having a shape corresponding to that of said groove.

4. The building formwork apparatus as claimed in claim 1, wherein said driven portion of said locking member has a protruding post protruding in a direction opposite to said shoulder.

5. The building formwork apparatus as claimed in claim 4, wherein said protruding post is polygonal.

6. The building formwork apparatus as claimed in claim 1, wherein said first tapered section and said second tapered section are integrally formed as a single piece.

7. A building formwork apparatus comprising:

a building formwork including a wall plate and a frame disposed on said wall plate, said wall plate having a mounting surface and a mold surface opposite to said mounting surface, said frame being disposed on said mounting surface, and having at least one positioning hole and at least one locking hole, said locking hole having an internally threaded section; and a locking member extending along and rotatable about an axis, and including a driven portion, a shoulder formed on one end of said driven portion, a positioning portion including a first tapered section connected to said shoulder, and a second tapered section connected to said first tapered section at a side opposite to said shoulder, said positioning portion gradually tapering from said first tapered section to said second tapered section in a direction away from said shoulder, each of said first tapered section and said second tapered section having a cross section smaller than that of said shoulder, and a threaded portion connected to said second tapered section at a side opposite to said first tapered section, said threaded portion having an external thread corresponding to said internally threaded section;

said positioning hole being configured to receive insertion of said locking member therethrough such that said first tapered section of said locking member is retained in said positioning hole to restrict said locking member to rotate about the axis and such that said second tapered section of said locking member is exposed from said positioning hole for connection with another building formwork apparatus;

said locking hole being adjacent to said positioning hole and being configured to receive a threaded portion and a second tapered section of a locking member of the another building formwork apparatus, said internally threaded section of said locking hole being configured to engage with the threaded portion of the another building formwork apparatus;

wherein each of said first tapered section and said second tapered section has a taper ratio of 1:8.

8. The building formwork apparatus as claimed in claim 7, wherein said driven portion of said locking member includes a surrounding wall, and a groove defined by said surrounding wall.

9. The building formwork apparatus as claimed in claim 8, wherein said locking member further includes a connecting rod portion received in said groove and having a shape corresponding to that of said groove.

10. The building formwork apparatus as claimed in claim 7, wherein said driven portion of said locking member has a protruding post protruding in a direction opposite to said shoulder.

11. The building formwork apparatus as claimed in claim 10, wherein said protruding post is polygonal.

12. The building formwork apparatus as claimed in claim 7, wherein said positioning hole has a large-diameter section corresponding to said driven portion, and a first tapered hole section corresponding to said first tapered section of said positioning portion, said locking hole further having a second tapered hole section corresponding to said second tapered section of said positioning portion.

13. The building formwork apparatus as claimed in claim 7, wherein said first tapered section and said second tapered section are integrally formed as a single piece.

* * * * *